US009387943B2

(12) United States Patent
Paradisi et al.

(10) Patent No.: US 9,387,943 B2
(45) Date of Patent: Jul. 12, 2016

(54) FORMING MEMBER FOR FORMING SEALED PACKAGES OF POURABLE FOOD PRODUCTS FROM A TUBE OF PACKAGING MATERIAL

(75) Inventors: Stefano Paradisi, Carpi (IT); Matteo Galloni, Nonantola (IT); Roberto De Pietri Tonelli, Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 560 days.

(21) Appl. No.: 13/883,253

(22) PCT Filed: Dec. 16, 2011

(86) PCT No.: PCT/IB2011/155751

§ 371 (c)(1),
(2), (4) Date: May 2, 2013

(87) PCT Pub. No.: WO2012/085804

PCT Pub. Date: Jun. 28, 2012

(65) Prior Publication Data

US 2013/0227918 A1 Sep. 5, 2013

(30) Foreign Application Priority Data

Dec. 21, 2010 (EP) ..... 10196340

(51) Int. Cl.
*B65B 1/02* (2006.01)
*B65B 9/12* (2006.01)
(Continued)

(52) U.S. Cl.
CPC ... *B65B 1/02* (2013.01); *B65B 9/12* (2013.01); *B65B 9/207* (2013.01); *B65B 9/2049* (2013.01); *B65B 9/2056* (2013.01)

(58) Field of Classification Search
CPC ..... B65B 61/24; B65B 9/2049; B65B 1/02; B65B 9/12; B65B 9/207; B65B 9/2056
USPC ..... 53/551
See application file for complete search history.

(56) References Cited

U.S. PATENT DOCUMENTS 4,617,779 A * 10/1986 Nygren ..... B65B 9/20 426/410
4,838,325 A * 6/1989 Bordini ..... B65B 9/2049 134/166 R (Continued)

FOREIGN PATENT DOCUMENTS

DE EP 0564695 A1 * 10/1993 ..... B65B 61/18
EP 0 104 696 A2 4/1984

(Continued)

OTHER PUBLICATIONS

International Search Report (PCT/ISA/210) issued on Jul. 27, 2012, by the European Patent Office as the International Searching Authority for International Application No. PCT/IB2011/055751.

(Continued)

*Primary Examiner* — Hemant M Desai
*Assistant Examiner* — Valentin Neacsu
(74) *Attorney, Agent, or Firm* — Buchanan Ingersoll & Rooney PC

(57) ABSTRACT

There is described a forming member for controlling the volume of packs of pourable food products formed from a tube of packaging material and sealed at a number of sections of tube crosswise to an axis of tube, comprising: a wall comprising, in turn, a first surface which is adapted to interact with a first portion of tube; and a pair of sidewalls protruding from wall on the same side of wall, and comprising respective second surfaces which are adapted to interact with relative second portions of tube; first surface is at least partially concave.

17 Claims, 10 Drawing Sheets

(51) Int. Cl.

| | |
|---|---|
| ***B65B 9/20*** | (2012.01) |
| ***B65B 9/207*** | (2012.01) |
| *B65B 61/24* | (2006.01) |

(56) References Cited

U.S. PATENT DOCUMENTS

| | | | | |
|---|---|---|---|---|
| 5,331,791 | A | 7/1994 | Fux et al. | |
| 5,970,687 | A * | 10/1999 | Katayama | B65B 9/20 53/451 |
| 6,085,495 | A * | 7/2000 | Fontanazzi | B29C 65/18 53/374.5 |
| 6,357,203 | B1 * | 3/2002 | Cicha | B31B 1/64 493/163 |
| 6,430,899 | B1 * | 8/2002 | Cicha | B31B 1/64 493/165 |
| 2005/0172574 | A1 * | 8/2005 | Paradisi | B65B 51/30 53/374.2 |
| 2009/0019819 | A1 * | 1/2009 | Karlsson | B29C 65/3656 53/551 |
| 2010/0205911 | A1 | 8/2010 | Fontanazzi et al. | |
| 2011/0120059 | A1 | 5/2011 | Andreotti et al. | |

FOREIGN PATENT DOCUMENTS

| | | | |
|---|---|---|---|
| EP | 0 274 154 | A1 | 7/1988 |
| EP | 0 829 425 | A2 | 3/1998 |
| EP | 2 042 433 | A1 | 4/2009 |
| EP | 2 151 390 | A1 | 2/2010 |
| JP | S59-084707 | A | 5/1984 |
| JP | H06-048404 | A | 2/1994 |
| JP | H10-086904 | A | 4/1998 |
| JP | 2009-526718 | A | 7/2009 |
| RU | 2 294 858 | C1 | 3/2007 |
| WO | WO 2007/114752 | A1 | 10/2007 |

OTHER PUBLICATIONS

Written Opinion (PCT/ISA/237) issued on Jul. 27, 2012, by the European Patent Office as the International Searching Authority for International Application No. PCT/IB2011/055751.

Extended European Search Report dated Feb. 28, 2014, issued by the European Patent Office in corresponding European Patent Application No. 13195210.3—1708. (5 pages).

Decision of Granting issued on Jan. 13, 2016, by the Russian Federal Service for Intellectual Property in corresponding Russian Patent Application No. 2013134148, and an English translation of the Grant (15 pages).

Office Action (Notice of Reasons for Rejection) issued Jan. 25, 2016, by the Japanese Patent Office in corresponding Japanese Patent Application No. 2013-545594, and an English Translation of the Office Action. (14 pages).

* cited by examiner

FORMING MEMBER FOR FORMING SEALED PACKAGES OF POURABLE FOOD PRODUCTS FROM A TUBE OF PACKAGING MATERIAL

The present invention relates to a forming member for forming sealed packages of pourable food product from a tube of packaging material.

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by creasing and sealing laminated strip packaging material. The packaging material has a multilayer structure comprising a base layer, e.g. of paper or mineral-filled polypropylene, and a number of layers of heat-seal plastic material, e.g. polyethylene film, covering both sides of the base layer.

In the case of aseptic packages for long-storage products, such as UHT milk, the packaging material also comprises a layer of oxygen-barrier material, e.g. an aluminium foil or ethylene vinyl alcohol (EVOH), which is superimposed on a layer of heat-seal plastic material, and is in turn covered with another layer of heat-seal plastic material forming the inner face of the package eventually contacting the food product.

As is known, packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating, from the surfaces of the packaging material.

The sterilized web of packaging material is maintained in a closed, sterile environment, and is folded into a cylinder and sealed longitudinally to form a tube.

The tube is fed in a vertical direction parallel to its axis, and is filled continuously with the sterilized or sterile-processed food product.

The packaging unit interacts with the tube to heat seal it at equally spaced cross sections and so form pillow packs connected to the tube by transverse sealing bands.

Pillows packs are then conveyed to a downstream folding unit, where they are folded so as to generate corresponding packages.

More specifically, the packaging unit comprises two forming assemblies movable along respective guides, and which interact cyclically and successively with the tube to heat seal the packaging material of the tube.

Each forming assembly comprises a slide which moves upwards and downwards along the respective guide; and two jaws hinged at the bottom to the slide and movable between a closed configuration, in which they cooperate with the tube to heat seal it, and an open configuration, in which they are detached from the tube.

More specifically, the jaws of each forming assembly are moved between the open and closed configurations by respective servomotors.

The movements of the forming assemblies are offset by a half-period. That is, one forming assembly moves upwards, with its jaws in the open configuration, while the other forming assembly moves downwards, with its jaws in the closed configuration, to prevent the assemblies from clashing.

The jaws of each forming assembly are fitted with respective sealing members, which cooperate with opposite sides of the tube, and comprise, for example, a heating member; and a member made of elastomeric material and which provides the necessary mechanical support to grip the tube to the required pressure.

Each forming assembly also comprises two forming members with respective forming half-shells hinged to the respective jaws.

Each two forming half-shells move cyclically between an open position, in which they are detached from the tube, and a closed position, in which they contact the tube and fold the portion of the tube between two consecutive sealing sections to define and control the volume of the pack being formed.

More specifically, the sealing device of a first forming assembly seals the bottom of the package being formed, and the half-shells of the first forming assembly control the volume of the package while the sealing device of the second forming assembly seals the top of the package being formed.

The forming half-shells may be spring-loaded by respective springs into the open position, and have respective rollers, which cooperate with respective cams designed to move the half-shells into the closed position by the time the forming assembly reaches a predetermined position as it moves down.

Each forming half-shell has a C-shaped cross section, and comprises, integrally, a main flat wall; and two parallel sidewalls projecting towards the axis of the tube of packaging material from respective opposite end edges of the main wall.

In the closed position, the main walls are located on opposite sides of the tube axis, are parallel to each other, and cooperate with respective first portions of the tube.

In the closed position, the sidewalls of one half-shell cooperate with respective second portions of the tube to completely control the volume of the package being formed, and, on the opposite side to the relative main wall, face corresponding sidewalls on the other half-shell.

Though performing excellently on the whole, packaging units of the type described leave room for improvement.

In particular, a need is felt within the industry for the maximum flexibility as regards the final shape of packages folded by the folding machine.

This is particularly so in the case of the newly conceived packages which have a front wall bulging on the opposite side of rear wall.

In which case, a need is felt for producing a pillow pack which may be as easy as possible folded into a corresponding final package with a bulging front wall.

Furthermore, the geometrical volume of the packages formed by the forming unit can be greater than the nominal volume required for containing a given weight of food product.

In order to fill the packages with the correct amount of food product, it is known to provide the flat walls of the half-shells with relative shims, which expel a certain amount of the food product from the packs in formation towards the portion of tube arranged upstream from the packs in formation.

In addition, gas is injected inside the tube during the formation of packs, so as to recover an additional amount of weight.

However, an additional kit is needed to inject the gas.

The Applicant has found that recovering of the additional amount of weight by increasing the thickness of the shims on the main walls of the half-shells could penalize the correct formation of the packs.

A need is felt within the industry to form packages with a volume of food product smaller than the geometrical volume of packages, without requiring additional kit and without requiring the presence of further additional shims on the half-shells.

It is an object of the present invention to provide a folding unit for producing sealed packages of pourable food products, and designed to provide at least one of the above aims in a straightforward, low-cost manner.

According to the present invention, there is provided a forming member for controlling the volume of packs of pourable food products, as claimed in claim 1.

The present invention also relates to a packaging unit for producing sealed packs of pourable food products.

Two preferred, non-limiting embodiments of the present invention will be described by way of example with reference to the accompanying drawings, in which.

Figure 1:
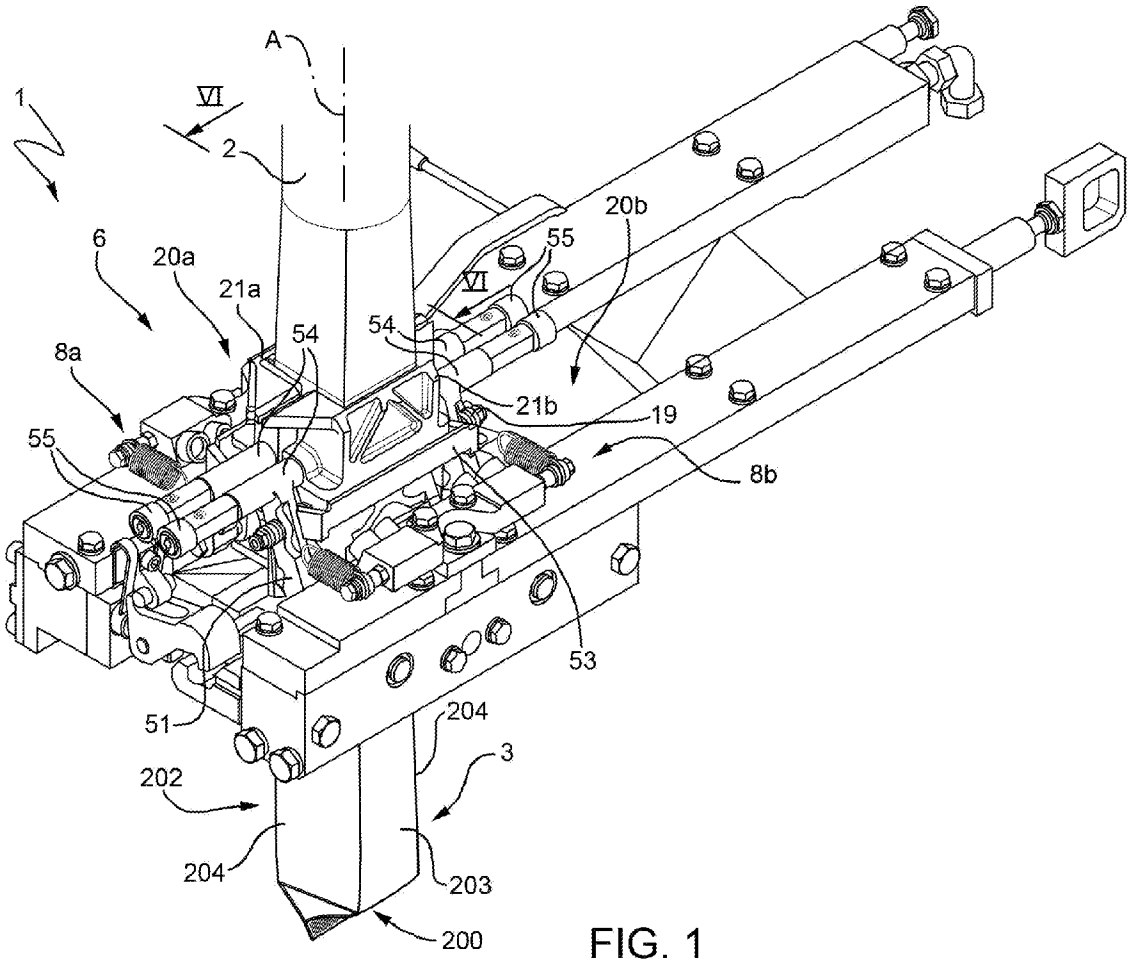
FIG. 1 is a perspective of a first embodiment of a packaging unit for forming sealed packages from a tube of a packaging material and which comprises a forming member in a closed configuration, in accordance with the present invention.
Figure 6:
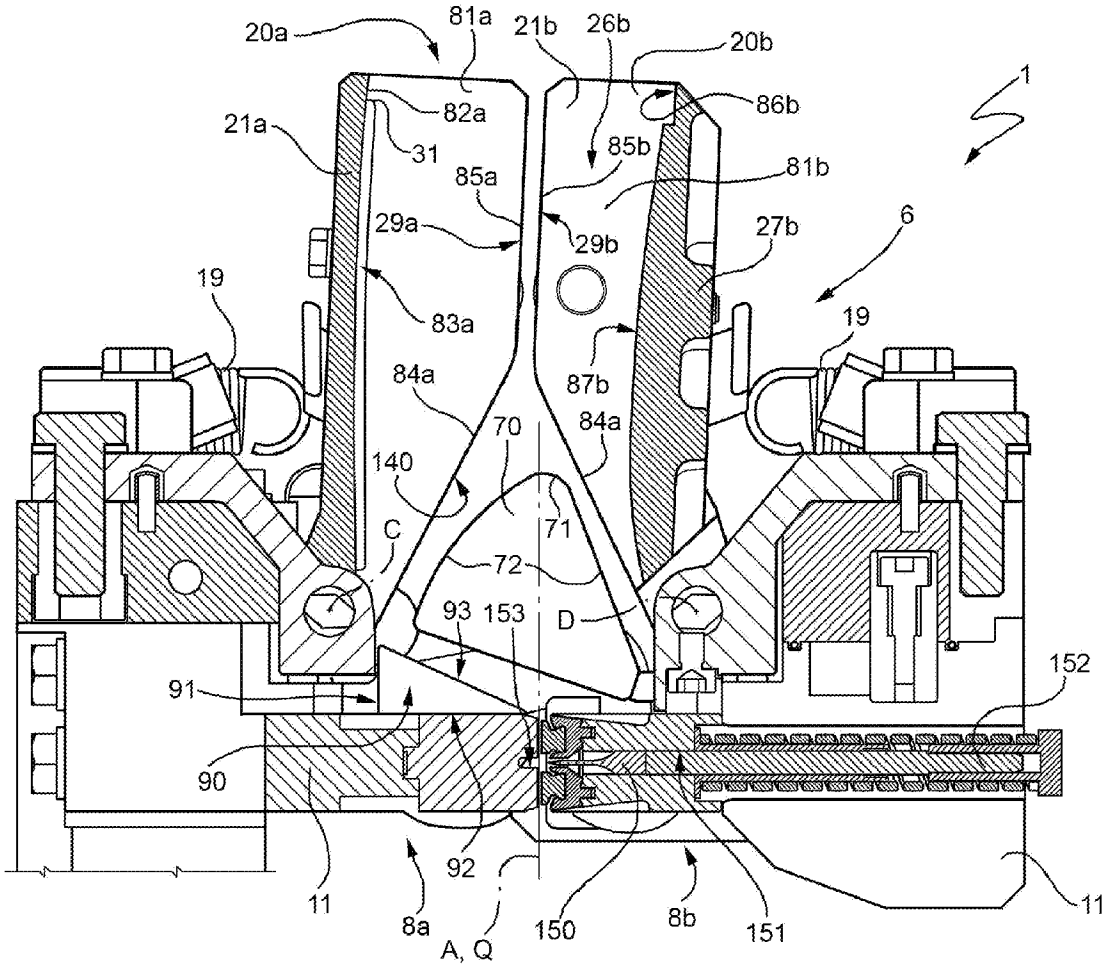
FIG. 6 is a section along line VI-VI of FIG. 1, with parts removed for clarity.
Figure 7:
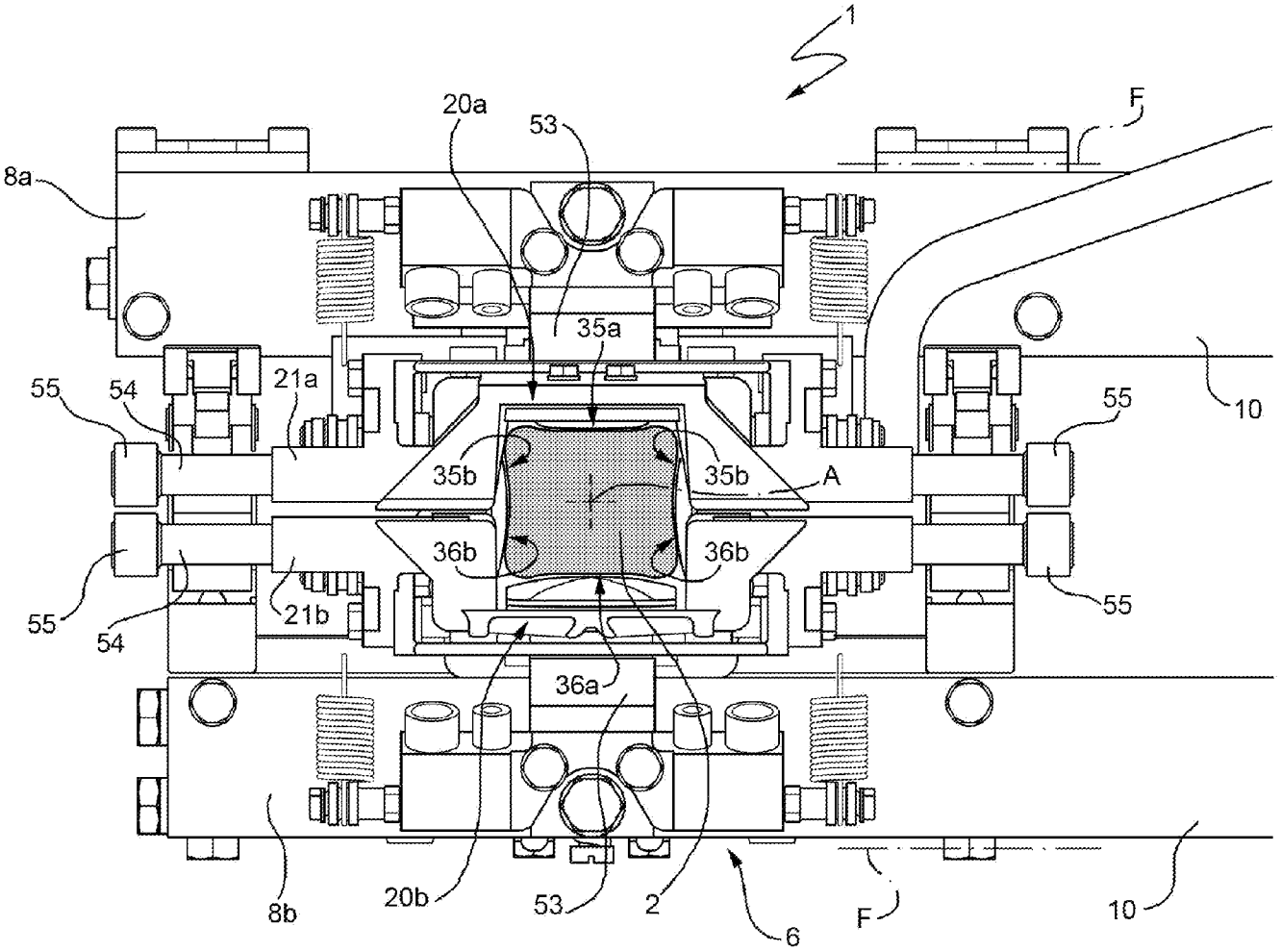
FIG. 7 is a top view of the forming unit of FIGS. 1 and 2.

With reference to FIGS. 1, 6 and 7, number 1 indicates as a whole a forming unit for producing sealed packs 3 of a pourable food product, such as pasteurized milk or fruit juice, from a tube 2 of sheet packaging material.

The packaging material has a multilayer structure (not shown), and comprises a layer of fibrous material, normally paper, covered on both sides with respective layers of heat-seal plastic material, e.g. polyethylene.

In the case of aseptic packages for long-storage products, such as UHT milk, the packaging material also comprises a layer of gas- and light-barrier material, e.g. aluminium foil or ethylene vinyl alcohol (EVOH) film, which is superimposed on a layer of heat-seal plastic material, and is in turn covered with another layer of heat-seal plastic material forming the inner face of the package eventually contacting the food product.

Tube 2 is formed in known manner by longitudinally folding and sealing a web (not shown) of heat-seal sheet material, is filled by a pipe (not shown) with the sterilized or sterile-processed food product for packaging, and is fed, in known manner not shown, along a vertical path having an axis A.

Unit 1 interacts with tube 2 to heat seal it at equally spaced cross sections and form a number of pillow packs 3 (FIG. 1) connected to tube 2 by sealing bands crosswise to axis A.

Packs 3 are then conveyed and folded into corresponding packages 4 in a folding unit (not shown) which is arranged downstream from forming unit 1.

Figure 8:
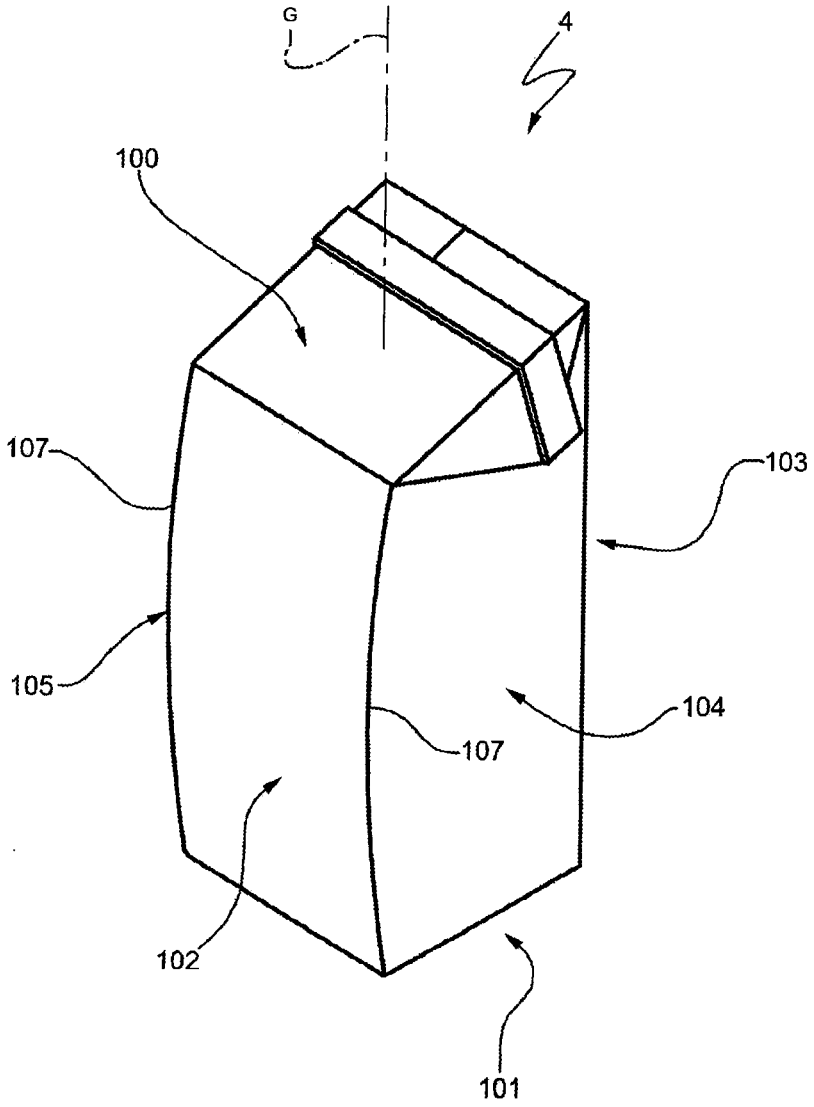
FIG. 8 is a perspective view of a sealed package folded by a folding unit which is arranged downstream from the forming unit of FIGS. 1 and 6.

With reference to FIG. 8, package 4 is of the type disclosed in the European Patent Application no. 10165116, which is hereby incorporated by reference.

Very briefly, package 4 extends along an axis G and comprises:

- a slanted top wall 100 inclined relative to axis G;
- a bottom wall 101 orthogonal to axis G;
- a convex front and a flat rear wall 102, 103 which extend between walls 100, 101; and
- a pair of concave lateral walls 104, 105 which extends between walls 100, 101 and between walls 102, 103.

Furthermore, convex front wall 102 is laterally bounded by two curved crease lines 107 which are opposite to each other and extend between walls 100, 101.

Unit 1 comprises at least two forming assemblies 6 (only one of which is shown in detail in FIGS. 1, 6 and 7), which move vertically along respective vertical cylindrical guides 5 symmetrical with respect to axis A, and interact cyclically with tube 2 to grip and heat seal it along equally spaced cross sections crosswise to axis A.

More specifically, assemblies 6 move upwards along guides 5 from a bottom dead-centre position to a top dead-centre position, and vice versa downwards.

Assemblies 6 being known and identical, only one is described below, and identical or corresponding parts of assemblies 6 are indicated in the attached drawings using the same reference numbers.

More specifically, assembly 6 substantially comprises a slide 7 that slides along respective guide 5; and two jaws 8*a*, 8*b* hinged at the bottom to slide 7 about respective horizontal axes F, which in use are horizontal and perpendicular to axis A.

Figure 2:
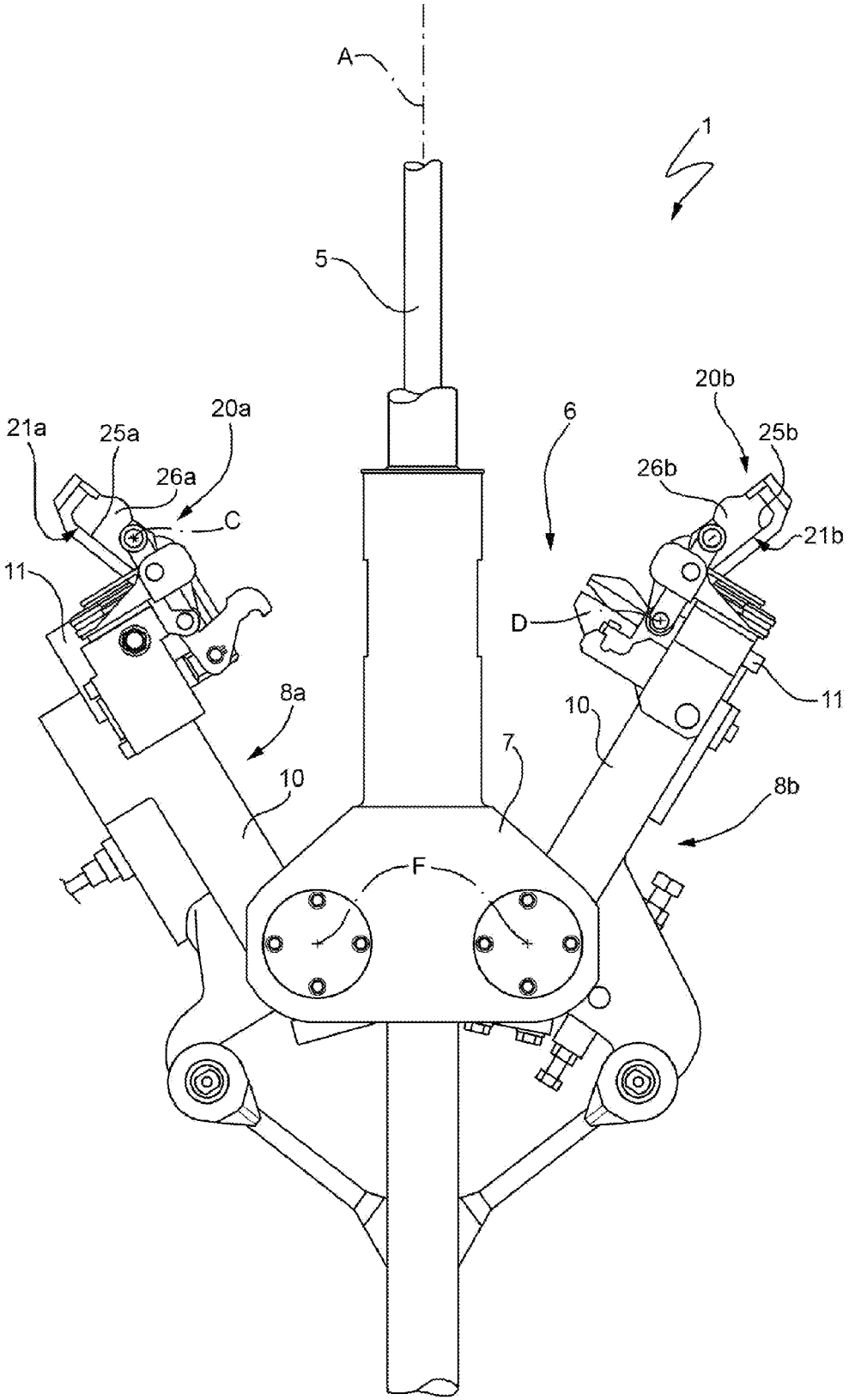
FIG. 2 is a side view of the forming unit of FIG. 1 with the forming member in an open configuration.

Jaws 8*a*, 8*b* are located on opposite sides of tube 2, and are movable, about respective axes F, between a closed configuration in which they grip tube 2 (FIG. 1), and an open configuration, in which they are detached from tube 2 (FIG. 2).

More specifically, each jaw 8*a*, 8*b* comprises a base portion 10 hinged at its bottom end to a bottom portion of slide 7 about respective axis F; and an arm 11, which interacts with tube 2, is connected to portion 10, and extends perpendicularly to axis A when jaws 8*a*, 8*b* are closed onto tube 2.

Jaws 8*a*, 8*b* are therefore moved vertically by slide 7 sliding along guide 5, and open and close with respect to tube 2 of packaging material by rotating about respective axes F about which they are hinged to slide 7; and the open-close movement is superimposed on the up-down vertical movement of slide 7.

The vertical and open-close movements are controlled respectively by known first and second actuating devices, not shown by not being essential to a clear understanding of the present invention.

Very briefly, the actuating devices provide for rotating jaws 8*a*, 8*b* in opposite directions and by the same angle about respective axes F.

The movements of the two assemblies 6 are offset by a half-period: a first assembly 6 travels upwards with relative jaws open while a second assembly 6 travels downwards, so that arms 11 of the first assembly 6 pass between corresponding arms of the second assembly 6 with no interference.

With reference to FIG. 6, assembly 6 also comprises a known sealing device, not shown in the drawings, to heat seal each cross section of the tube 2 of packaging material gripped between relative jaws 8*a*, 8*b*.

The sealing device comprises a heating member fitted to arm 11 of jaw 8*b*, and which interacts with tube 2 by means of two active surfaces; and two pressure pads fitted to arm 11 of jaw 8*a*, and which cooperate with respective active surfaces of the heating member to grip and heat seal tube 2 (FIG. 6).

Jaw 8*b* also comprises a cutting member 150 and a front seat 151 which normally houses cutting member 150.

In detail, cutting member 150 is normally maintained in a withdrawn rest position in which it is housed completely inside seat 151 by a helical spring 152. Cutting member 150 is moved by a not-shown actuator into a forward cutting position, in which it projects frontwards from jaw 8*b*, engages a groove 153 defined by arm 11 of jaw 8*a*, and cuts the tube 2.

Assembly 6 also comprises (FIGS. 2, 5 and 6):

- two forming members 20*a*, 20*b*, also called volume boxes, facing each other on opposite sides of axis A, and hinged to arm 11 of respective jaws 8*a*, 8*b* about relative axes C, D parallel to each other and crosswise to axis A; and
- a pair of folding flaps 70 (only one of which is shown in FIG. 6) which are hinged to arm 11 of jaw 8*b* about relative axes D.

With reference to FIG. 6, jaw 8*a* comprises a wedge 90 which is bounded by a wall 91 parallel to axis A, a wall 92 orthogonal to wall 91 and axis A, and a wall 93 slanted relative to walls 91, 92.

Wedge 90 is fixed to jaw 8*a*.

Walls 91, 92, 93 are planar.

In other words, walls 91, 92, 93 form a rectangular triangle in a section parallel to axis A.

Wall 91 of wedge 90 rests above arm 11 of jaw 8*a* and wall 93 is arranged relative to wall 91 on the side of forming members 20*a*, 20*b*.

Wall 93 extends between an edge 94 in common with wall 91 and an edge 95, opposite to edge 94, in common with wall 92.

Folding flaps 70 are arranged on either side of tube 2 and comprise each, in the embodiment shown, a substantially triangular main portion.

Main portion of each folding flap 70 comprises an apex 71 on the opposite side of axis D and two lateral sides 72 diverging from apex towards axis D The surfaces of folding flaps 70 adapted to cooperate with tube 2 are advantageously convex.

In detail, flaps 70 is adapted to form a bottom end 200 (FIG. 1) and at least part of lateral walls 204 of pack 3 which are intended to form respectively wall 100 and walls 104 of package 4.

Wall 93 of wedge 90 cooperates with flap 70 to form bottom end 200 (FIG. 1) of pack 3, which is intended to be folded into wall 100 of package 4.

Each forming member 20*a*, 20*b* comprises (FIGS. 3, 4 and 5):

- a respective half-shell 21*a*, 21*b* which substantially comprises a main wall 25*a*, 25*b* and a pair of sidewalls 26*a*, 26*b* protruding from wall 25*a*, 25*b* towards axis A;
- two levers 51 extending alongside relative sidewalls 26*a*, 26*b* on the opposite sides of corresponding wall 25*a*, 25*b* and hinged to arm 11 of relative jaw 8*a*, 8*b* about relative axes C, D crosswise to axis A;
- a crosspiece 53 having, in turn, respective end portions connected to relate levers 51 and an intermediate portion, which face relative wall 25*a*, 25*b* on the opposite side of axis A; and
- a pair of arms 54 which protrude, integrally to levers 51, from respective sidewalls 26*a*, 26*b* on respective sides opposite to each other, and are fitted with respective cam follower rollers 55.

Due to the fact that forming members 20*a*, 20*b* are hinged to relative jaws 8*a*, 8*b* about respective axes C, D, half-shells 21*a*, 21*b* are movable between an open position (FIG. 2), into which they are pushed by a coil spring 19 (FIG. 6), and a closed position (FIG. 1), in which they mate to define a space defining the shape and the volume of packs 3 being formed between half-shells 21*a*, 21*b*.

Half-shells 21*a*, 21*b* are moved from open to closed position by the interaction of rollers 55 with a not-shown fixed cam extending parallel to axis A.

More specifically, as assembly 6 moves downwards and jaws 8*a*, 8*b* are closed, half-shells 21*a*, 21*b* perform a work cycle comprising:

- a closing stroke, in which half-shells 21*a*, 21*b* move towards tube 2 from the open to the closed position;
- a volume-control stroke, in which half-shells 21*a*, 21*b* cooperate with tube 2 (FIGS. 1 and 7); and
- an opening stroke produced by springs 19 (FIG. 6), and in which half-shells 21*a*, 21*b* withdraw from tube 2 from the closed to the open position.

As assembly 6 moves upwards and jaws 8*a*, 8*b* are open, half-shells 21*a*, 21*b* perform a return stroke, in which they are detached from tube 2 by spring 19 (FIG. 2).

Figure 3:
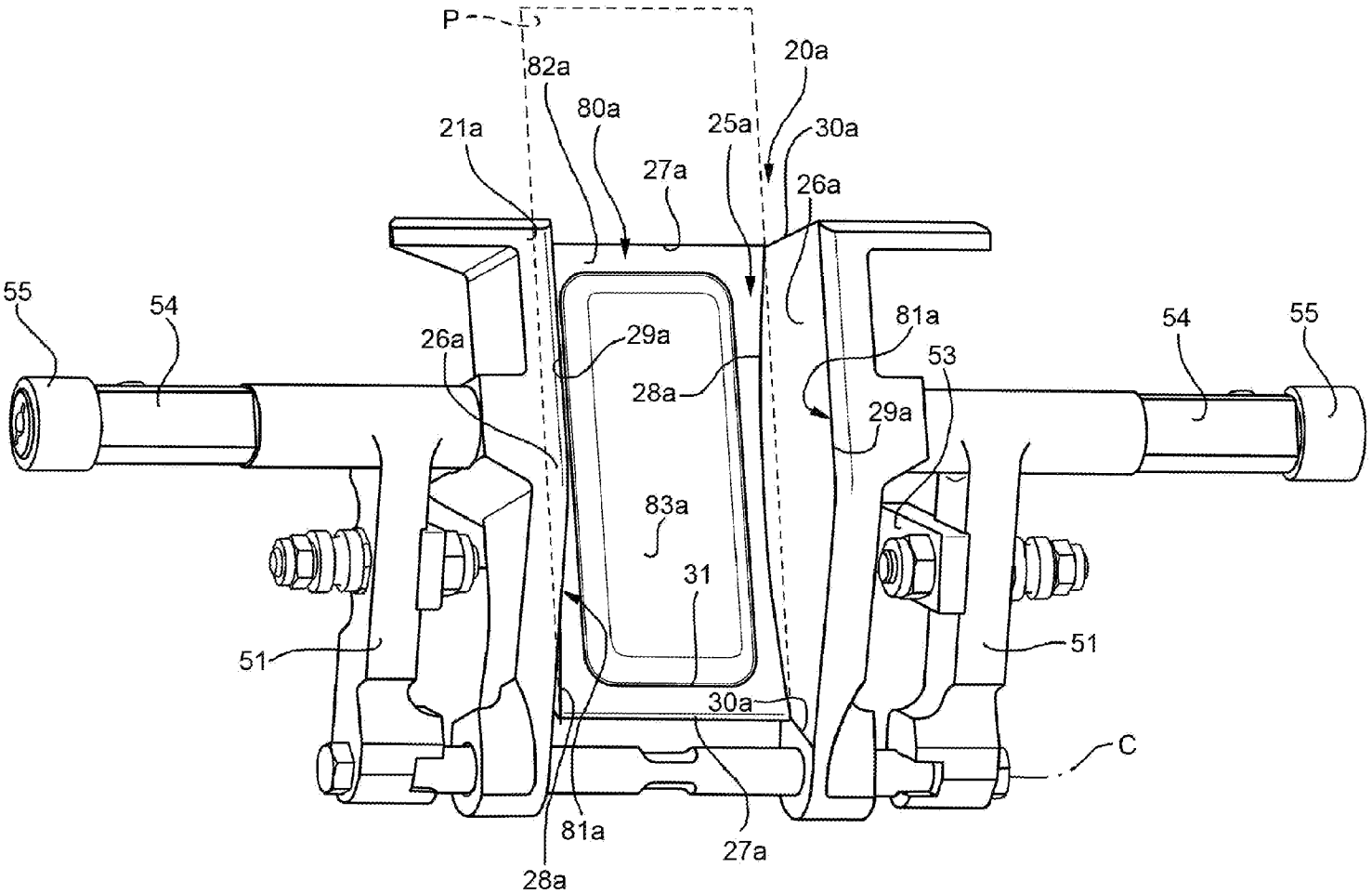
FIG. 3 is an enlarged perspective view of a forming member of the forming unit of FIGS. 1 and 2.
Figure 4:
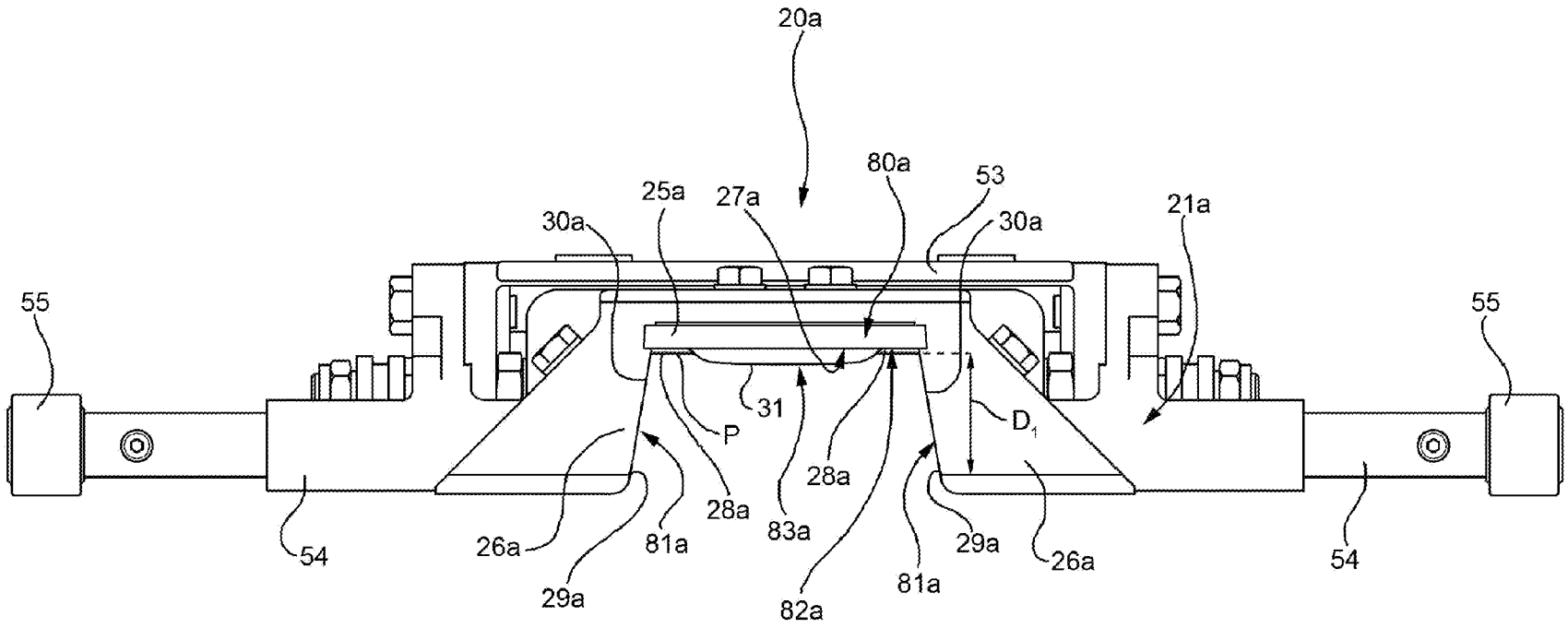
FIG. 4 is a top view of the forming member of FIG. 3.
Figure 5:
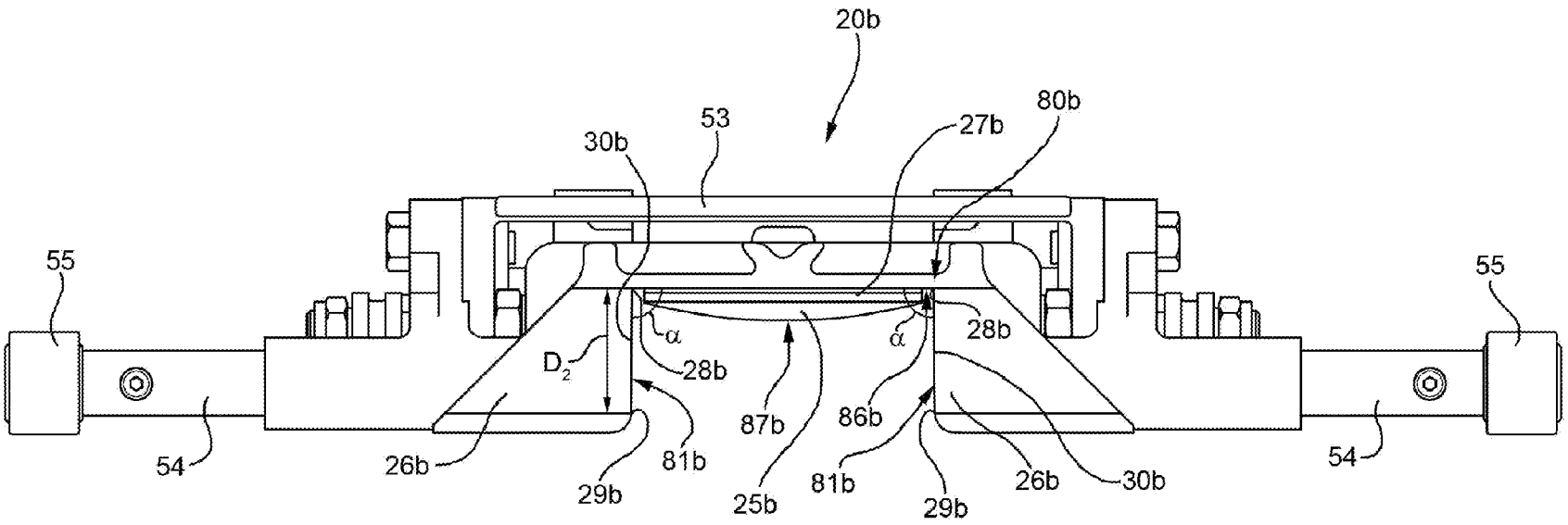
FIG. 5 is a top view of a further forming member of the folding unit of FIGS. 1 and 2.

With reference to FIGS. 3 to 5, main wall 25*a*, 25*b* of each half-shell 21*a*, 21*b* defines, on the side of axis A, a surface 80*a*, 80*b*; and sidewalls 26*a*, 26*b* define relative surfaces 81*a*, 81*b* protruding from relative surfaces 80*a*, 80*b* towards axis A and facing each other.

In detail, each surface 80*a* (80*b*) of wall 25*a* (25*b*) is bounded by:

- top and bottom end edges 27*a*, 27*b* parallel to each other; and
- end edges 28*a*, 28*b* parallel to each other and interposed between edges 27*a*, 27*b*.

Each surface 81*a* (81*b*) of sidewalls 26*a* (26*b*) is bounded by:

- end edge 28*a* (28*b*) on the opposite side to axis A;
- an end edge 29*a* (29*b*) which is arranged on the side of axis A; and
- a pair of top and bottom edges 30*a* (30*b*) arranged between end edge 28*a* (28*b*) and end edge 29*a* (29*b*).

Edges 30*a* (30*b*) are opposite to each other and extend one between bottom points of edges 28*a*, 29*a* (28*b*, 29*b*) and the other one between top points of edges 28*a*, 29*a* (28*b*, 29*b*).

When half-shells 21*a*, 21*b* perform the control volume stroke, surfaces 80*a*, 80*b* of walls 25*a*, 25*b* cooperate with respective first portions 35*a*, 35*b* (FIG. 7) of tube 2 extending between two consecutive sealing sections and located on opposite sides of axis A.

Furthermore, surfaces 81*a*, 81*b* of sidewalls 26*a*, 26*b* cooperate with relative portions 36*a*, 36*b* of tube 2, extending between said two sealing sections of tube 2, to control the volume of the pack 3 being formed between the two consecutive sealing sections.

Edges 29*a*, 29*b* of sidewalls comprise, proceeding from relative axes C, D towards relative top edges 30*a*, 30*b*:

- relative first portions 84*a*, 84*b* which extend at increasing distances from relative edges 28*a*, 28*b*; and
- relative portions 85*a*, 85*b* which extend substantially at the same distances from relative edges 28*a*, 28*b* and are parallel to each other, when half-shells 21*a*, 21*b* cooperate with tube 2 (FIG. 6).

Portions 84*a*, 84*b* define, when half-shells 21*a*, 21*b* cooperate with tube 2 (FIG. 6), two triangular openings 140 arranged on either side of tube 2 and partially engaged relative folding flaps 70.

In detail the width of openings 140 measured orthogonally to axis A increases proceeding from relative axes C, D towards corresponding top edges 30*a*, 30*b*.

Portions 35*a*, 36*a* of tube 2 form respectively the front and rear wall 202, 203 (FIG. 1) of pack 3, after the forming thereof has been completed.

Portions 35*b* and 36*b* form the lateral walls 204 of pack 3, after the forming thereof has been completed.

When jaws 8*a*, 8*b* are in the closed configuration, relative arms 11 cooperate along an interaction surface which lies on a plane Q parallel to axis A (FIG. 6). In which case, the distance between axis C of forming member 20*b* from plane Q (and axis A) is greater than the distance between axis D of forming member 20*a* form such a plane Q (and axis A).

Surface 80*a* is advantageously concave.

In greater detail, surface 80*a* comprises (FIGS. 3, 4 and 6):

a first concave area 82*a* bounded, on opposite sides, by edges 28*a*, 29*a*, 30*a* and by a curved closed boundary 31; and a second concave area 83*a* rounded to area 82*a*, projecting from the boundary 31 on side of axis A, and gently rounded to area 82*a*.

In detail, edges 27*a* defines a plane P and whole surface 80*a* extends on the side of plane P which is opposite to sidewalls 26*a* and to axis A.

Edges 28*a* extends at first at increasing and then at decreasing distances form plane P, when proceeding from top edge 27*a* towards bottom edge 27*a*.

Furthermore, edges 28*a* converge towards each other and diverge from each other, when proceeding from top edge 27*a* towards bottom edge 27*a*.

Preferably, edges 28*a* are curved.

With reference to FIGS. 5 and 6, surface 80*b* of wall 25*b* comprises:

a main flat area 86*b*; and a convex shim 87*b* projecting from area 86*b* towards axis A.

Surfaces 81*b* of sidewalls 26*b* are flat and define (FIG. 5) respective angles α with area 86*b*. Each angle α is greater than 90 degrees, so that surfaces 81*b* diverge from surface 80*b* towards axis A.

Preferably, each angle α ranges between 90 to 95 degrees, the end-points not included. In particular, angle α ranges between 91 and 92 degrees.

Finally, the maximum distance D1 (FIG. 4) between edges 29*a* of sidewalls 26*a* and surface 82*a* of wall 25*a* is greater than the maximum distance D2 between edges 29*b* of sidewalls 26*b* and area 86*b* of wall 25*b* (FIG. 5).

Distance D1 is measured orthogonally to plane P and distance D2 is measured orthogonally to area 86*b*.

In actual use, tube 2, filled with the liquid food product is fed along axis A, and first and second assemblies 6, operating a half-period out of phase, move upwards and downwards along respective guides 5.

More specifically, first assembly 6 moves upwards, with jaws 8*a*, 8*b* open, at the same as second assembly 6 moves down, with jaws 8*a*, 8*b* closed, so that arm 11 of second assembly 6 pass between, and so avoid interfering with, arms 11 of first assembly 6.

Operation of unit 1 is described below with reference to first assembly 6 only, and as of the top dead-centre position, in which jaws 8*a*, 8*b* are open.

As of the top dead-centre position, jaws 8*a*, 8*b* begin moving downwards and, as they do so, interact with respective cam actuating device to move into the closed configuration.

At the same time, half-shells 21*a*, 21*b* perform their work cycle. In detail, half-shells 21*a*, 21*b* move towards tube 2 from the open to the closed position under the action of not-shown cam.

Once that half-shells 21*a*, 21*b* are closed about tube 2, the sealing device is activated, and half-shells 21*a*, 21*b* control the volume and the shape of the pack 3 being formed as tube 2 is transversally heat-sealed.

In greater detail, surfaces 80*a*, 80*b* of walls 25*a*, 25*b* cooperate with respective first portions 35*a*, 35*b* (FIG. 7) of tube 2 extending between two consecutive sealing sections and located on opposite sides of axis A, and surfaces 81*a*, 81*b* of sidewalls 26*a*, 26*b* cooperate with relative portions 36*a*, 36*b* of tube 2, extending between said two sealing sections of tube 2.

Furthermore, sidewalls 26*a*, 26*b* define, on either sides of tube 2, openings 140 which are engaged by relative flaps 70 and wedge 90.

Due to the fact that surface 80*a* and interacting surfaces of flaps 70 are concave, and surfaces 81*a* are convex, front wall 202 of pack 3—corresponding substantially to portion 35*a*—is formed as convex and lateral walls 204 of pack 3 are formed at least in part as concave.

Furthermore, flaps 70 and wall 93 of wedge 90 are adapted to form bottom end 200 and at least part of lateral walls 204 of pack 3 which are intended to form respectively wall 100 and walls 104 of package 4.

Once that sealing has been completed, cutting member 150 is actuated and moved to the forward cutting position, so as to cut tube 2 along the previously formed transversal sealing and to separate the formed pack 3 from the remaining part of tube 2.

At this stage, half-shells 21*a*, 21*b* withdraw from tube 2 under the action of springs 19 until they reach the open position.

As assembly 6 reaches the bottom dead centre position, jaws 8*a*, 8*b* move into the open configuration.

Assembly 6 then travels upwards, while assembly 6' travels downwards with relative jaws in the closed configuration.

The formed packs 3 are conveyed to the folding unit which is arranged downstream from unit 1 so as to form relative packages 4.

Figure 9:
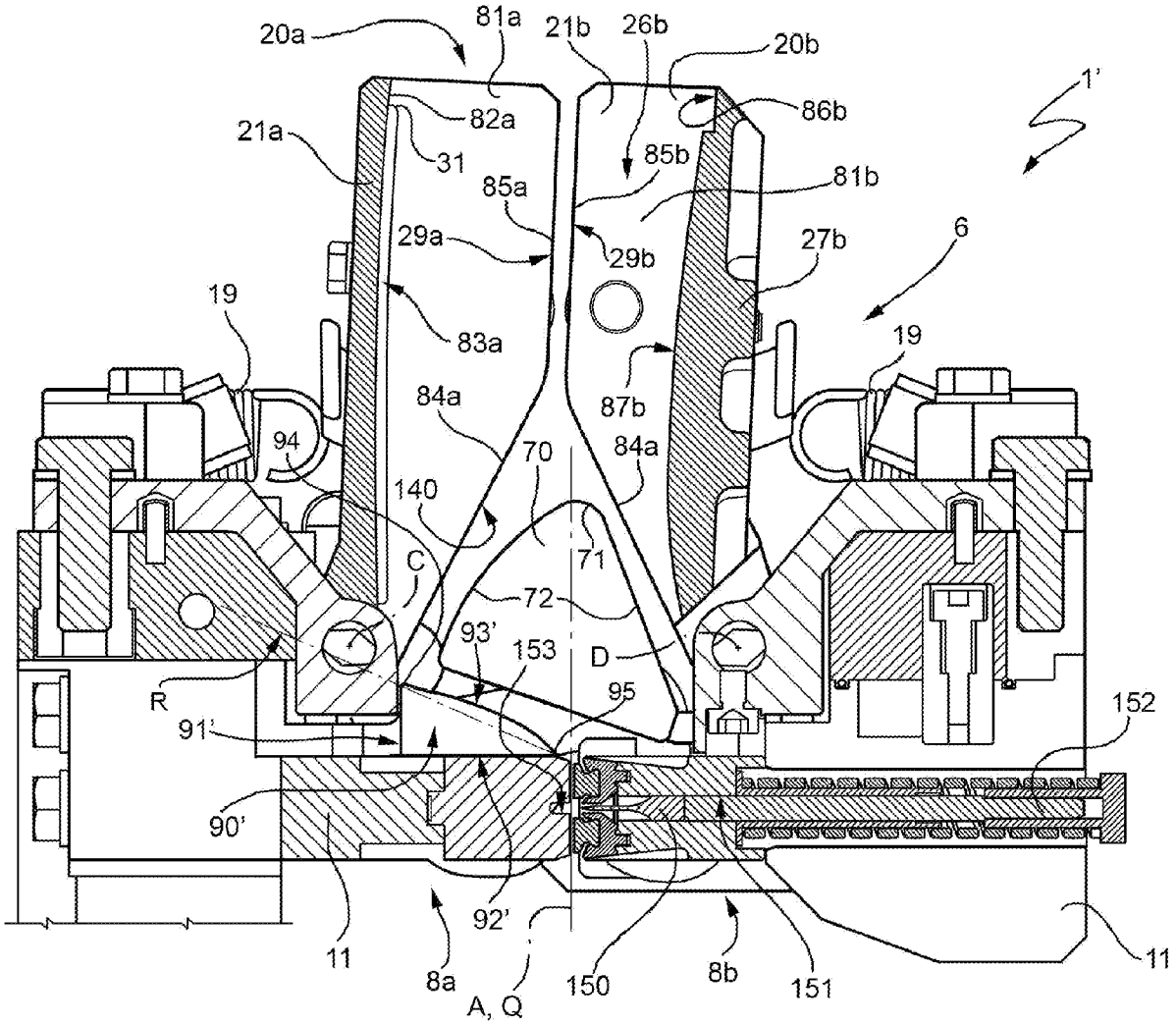
FIG. 9 is a section along line VI-VI of a second embodiment of a packaging unit, with parts removed for clarity.

Number 1' in FIG. 9 indicates as a whole a different embodiment of a folding unit in accordance with the present invention.

Unit 1' is similar to unit 1, and is only described below as regards the differences between the two; any corresponding or equivalent parts of unit 1, 1' being indicated, where possible, using the same reference numbers.

In particular, unit 1' differs from unit 1 in that edges 94, 95 of wedge 90' are joined by a plane R and in that wall 93' of wedge 90' wholly extends on the side of plane R opposite to jaw 8*a*.

Figure 10:
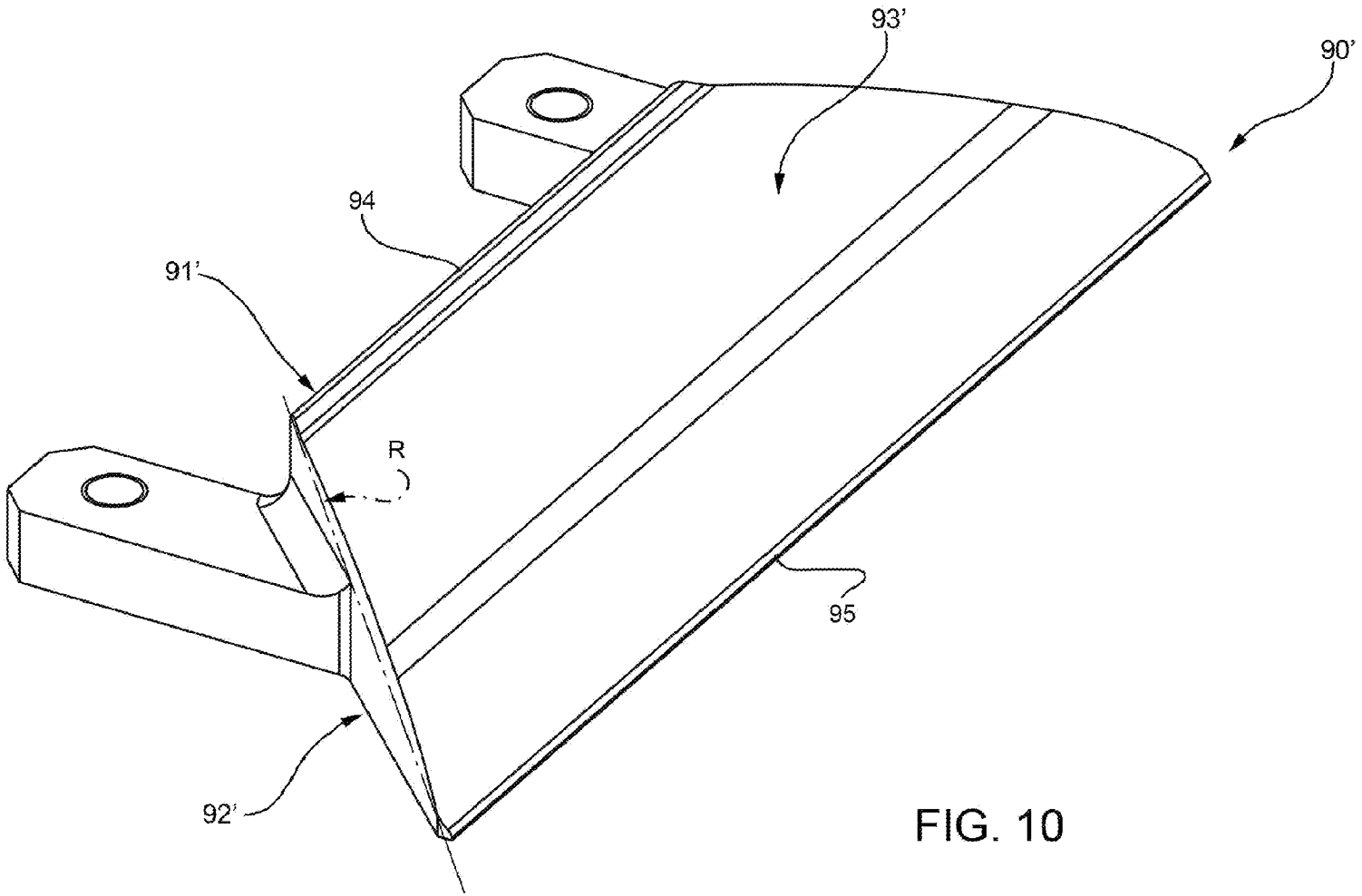
FIG. 10 is an enlarged perspective view of a component of the unit of FIG. 9.

In other words, wall 93' bulges towards forming members 20*a*, 20*b*, when the latter are in the closed configuration (FIGS. 9 and 10).

More precisely, wall 93' is convex and curved.

The operation of unit 1' differs from the one of unit 1 in that wall 93', due to its curved conformation, expels a certain amount of food product away from pack 3 which is being formed upwards and inside the portion of tube 2 arrange above pack 3.

In this way, pack 3 may be formed with a geometrical volume that is greater than the nominal volume of food product that packs 3 contains.

The advantages of member 20*a* according to the present invention will be clear from the foregoing description.

In particular, member 20*a* forms a pack 3 which may be easily transformed in package 4 inside the folding unit which is arranged downstream from unit 1.

As a matter of fact, surface 80*a* interacting with portion 35*a* of tube being concave, front wall 202 of pack 3 is formed as convex.

Therefore, convex wall 102 of package 4 may be easily obtained by the folding, inside the folding unit, of such a convex front wall 202 of pack 3.

Furthermore, surfaces 81*a* interacting with portions 35*b* of tube 2 being convex, lateral walls 204 of pack 3 are formed at least in part as concave.

Therefore, concave walls 104, 105 may be easily obtained by the folding, inside the folding unit, of such partially concave lateral walls 204 of pack 3.

The convex conformation of surfaces 81*a* also dramatically reduce the risk that tube 2 twists about axis A, as a result of the interaction of wall 25*a* with portions 35*a* during the control-volume stroke of half-shells 21*a*, 21*b*.

Furthermore, the Applicant has found that the precision and the repeatability of forming of packs 3 is highly improved by the fact that flaps 70 enter relative openings 140, when corresponding half-shells 21*a*, 21*b* are closed about tube 2 (FIG. 6).

Moreover, flaps 70 being convex, they are highly effective in precisely enhancing the concave shape of lateral walls 204.

Flaps 70 are also effective in squeezing out a given amount of product from packs 3 being formed, so as to precisely control the amount of product within the package close to the nominal volume.

Finally, if the angles α are greater than 90 degrees, the risk that the interaction of sidewalls 26*b* with portions 36*b* causes the twisting of tube 2 about axis A is further reduced.

Due to the fact that it projects from area 82*a* towards axis A, concave area 83*a* of surface 81*a* is effective in expelling a given amount of pourable product from the volume intended to form pack 3 towards the remaining part of tube 2.

In this way, the presence of area 83*a* provides for controlling the amount of pourable food product contained in packs 3, while ensuring at the same time that front wall 202 is formed as convex.

Unit 1' is particularly advantageous because it can form packs 3' having a geometrical volume that is greater than the nominal volume of food product it contains, by using bulging walls 93' of wedge 90 for expelling an additional amount of pourable product from the volume intended to form pack 3 towards the remaining part of tube 2.

In this way, the final volume of pack 3 may be controlled without increasing the extent to which area 83*a* projects from area 82*a* and/or the thickness of shim 87*b*.

Furthermore, the final volume of pack 3 may be controlled without requiring the injection of a gas inside tube 2.

Clearly, changes may be made to member 20*a* as described and illustrated herein without, however, departing from the scope defined in the accompanying Claims.

In particular, forming member 20*b* could be fitted to jaw 8*a* and forming member 20*a* could be fitted to jaw 8*b*.

Furthermore, jaw 8*a*, 8*b* could be fitted to respective counter rotating chain conveyors which extend on respective sides of tube 2 opposite to one another.

Wedge 90' could be fitted to jaw 8*b*.

Unit 1' could be used for forming packages 4 having a flat wall 102.

In this case, jaws 8*a*, 8*b* would be provided with a forming a member 20*a* having a flat surface 80*a*.

The invention claimed is:

1. A forming member for controlling a volume of packs of pourable food products formed from a tube of packaging material and sealed at a number of sections of said tube crosswise to an axis of said tube, comprising:

a wall comprising, in turn, a first surface which is adapted to interact with a first portion of said tube;

a pair of sidewalls protruding from the first surface of said wall in a sidewall protruding direction, and comprising respective second surfaces which are adapted to interact with relative second portions of said tube;

the first surface comprising a first concave surface and a second concave surface, the second concave surface protruding beyond said first concave surface in the sidewall protruding direction; and the first concave surface surrounding the second concave surface.

2. Forming member according to claim 1, wherein said first concave surface is bounded by a first top edge and a second bottom edge opposite to the first top edge, and by a third edge and a fourth edge opposite to one another and which extend between said first top edge and said second bottom edge;

said first top edge and said second bottom edge defining a first plane;

said third edge and fourth edge defining side edges of said respective second surfaces and extending at first at increasing and then at decreasing distances from said first plane, proceeding from said first top edge towards said second bottom edge.

3. Forming member according to claim 2, wherein said third edge and said fourth edge converge towards each other and diverge from each other, proceeding from said first top edge towards said second bottom edge.

4. Forming member according to claim 2, wherein said third edge and said fourth edge are curved.

5. Forming member according to claim 1, wherein a portion of said second surfaces is convex.

6. A packaging unit for producing sealed packs of pourable food products, comprising a first jaw and a second jaw movable cyclically between a closed configuration, in which the first jaw and the second jaw grip and seal a tube of packaging material, and an open configuration, in which the first jaw and the second jaw are detached from said tube;

said first jaw having a forming member according to claim 1;

said second jaw having a further forming member;

said further forming member comprising:

a further wall comprising a third surface which is adapted to interact with a third portion, opposite to said first portion, of said tube; and a pair of further sidewalls protruding from said third surface of said further wall, and comprising respective fourth surfaces which are adapted to interact with relative fourth portions, adjacent to the relative second portions, of said tube.

7. The packaging unit according to claim 6, wherein an angle between said third surface and said fourth surface is more than 90 degrees.

8. The packaging unit according to claim 7, wherein said angle is greater than 90 degrees and less than 95 degrees.

9. The packaging unit of claim 6, wherein a maximum distance from said first surface to said second surface is greater than a maximum distance from said third surface to said fourth surface.

10. The packaging unit of claim 6, wherein said second jaw comprises a cutting element adapted to cut said tube transversally to said axis of the tube when said first and second jaws are arranged in said closed configuration;

said forming member being hinged to said first jaw about a second axis transversal to said axis of the tube, and said further forming member being hinged to said second jaw about a third axis transversal to said axis of the tube;

the distance between said axis of the tube and said second axis measured orthogonally to said axis of the tube and said second axis being greater than the distance between said axis of the tube and said third axis measured orthogonally to said axis of the tube and said third axis.

11. The packaging unit of claim 6, comprising at least one folding flap which is adapted to fold an axial end and to form at least a part of lateral walls of each of said packs;

said forming members defining, when they are in a closed configuration in which they cooperate with said tube, at least one opening engaged by said folding flap.

12. The packaging unit of claim 11, wherein said at least one folding flap has a convex surface, which is adapted to interact with said tube when said forming members are in said closed configuration.

13. The packaging unit of claim 11, comprising a pair of said folding flaps, said sidewalls of said forming members defining a pair of said openings engaged by said folding flaps when said forming members are in said closed configuration.

14. The packaging unit of claim 6, comprising a wedge which is adapted to fold an axial end of each of said packs; said axial end being intended to form an axial end wall of a corresponding package inclined relative to a fourth axis of said package;

said wedge being carried by one of said first and second jaws and comprising a wall which cooperates with and folds, in use, said axial end of said pack;

said wall having a first and a second end edges joined by a second plane;

said wall extending on an opposite side of said second plane relative to said one of said first and second jaws.

15. The packaging unit of claim 14, wherein said wall is convex.

16. The packaging unit of claim 15, wherein said forming members define, when they are in a closed configuration in which they cooperate with said tube, at least one opening engaged by at least one folding flap which is adapted to fold an axial end and to form at least a part of lateral walls of each of said packs, and wherein said wedge engages a part of said opening.

17. A packaging unit for producing sealed packs of pourable food products intended to be folded into corresponding packages; said packages having an end axial slanted wall relative to a longitudinal axis of said packages, being formed from a tube of packaging material, said packages;

said packaging unit comprising a first jaw and a second jaw movable cyclically between a closed configuration, in which they grip and seal said tube and an open configuration, in which they are detached from said tube;

said first jaw and said second jaw having respective forming members for controlling a volume of said packs, when said first jaw and said second jaw are in said closed configuration;

said first jaw comprising a wedge;

said wedge comprising a wall which is adapted to cooperate with and to form an axial end of said pack intended to be folded into said slanted wall, wherein said wall has a first end edge and a second end edge;

said wall being convex and protruding towards said second jaw, and said wall possessing a curved shape between said first end edge and said second end edge.

* * * * *